US011043156B2

(12) United States Patent
Sung et al.

(10) Patent No.: US 11,043,156 B2
(45) Date of Patent: Jun. 22, 2021

(54) DISPLAY DEVICE AND DRIVING METHOD THEREOF

(71) Applicant: Samsung Display Co., Ltd., Yongin-si (KR)

(72) Inventors: Si Duk Sung, Hwaseong-si (KR); Sang Hyun Lee, Seongnam-si (KR); Bo Yeon Kim, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/861,926

(22) Filed: Apr. 29, 2020

(65) Prior Publication Data

US 2021/0074194 A1 Mar. 11, 2021

(30) Foreign Application Priority Data

Sep. 11, 2019 (KR) ..... 10-2019-0113141

(51) Int. Cl.
*G09G 3/20* (2006.01)

(52) U.S. Cl.
CPC ..... *G09G 3/20* (2013.01); *G09G 2300/0426* (2013.01); *G09G 2310/0213* (2013.01); *G09G 2310/0243* (2013.01); *G09G 2310/0267* (2013.01); *G09G 2310/08* (2013.01); *G09G 2330/02* (2013.01); *G09G 2330/08* (2013.01)

(58) Field of Classification Search
CPC ..... G09G 3/20; G09G 2310/0243; G09G 2310/0213; G09G 2310/0267; G09G 2330/02; G09G 2330/08; G09G 2310/08; G09G 2300/0426
See application file for complete search history.

(56) References Cited

U.S. PATENT DOCUMENTS 10,121,405 B2 * 11/2018 Kim ..... G09G 3/2092
2001/0033266 A1 * 10/2001 Lee ..... G09G 3/3677 345/94
2014/0043314 A1 * 2/2014 Park ..... G06F 3/038 345/212

(Continued)

FOREIGN PATENT DOCUMENTS

KR 1995-0001375 A 1/1995
KR 10-1324428 B1 10/2013

(Continued)

*Primary Examiner* — Ibrahim A Khan
(74) *Attorney, Agent, or Firm* — Lewis Roca Rothgerber Christie LLP

(57) ABSTRACT

A display device includes a display panel, a power supply, a signal controller configured to generate first and second clock signals having a period, a clock signal generator configured to generate a gate clock signal that is raised to a high level voltage in synchronization with the first clock signal, and that falls to a low level voltage in synchronization with the second clock signal, generate a panel separation signal by comparing a voltage of the gate clock signal with a first reference voltage during a falling period during which the gate clock signal falls, and transfer the panel separation signal to the power supply or the signal controller, and a gate driver configured to sequentially apply a gate signal by using the gate clock signal, wherein the power supply or the signal controller is configured to stop outputting depending on the panel separation signal.

20 Claims, 10 Drawing Sheets

(56) References Cited

U.S. PATENT DOCUMENTS

| | | | | |
|---|---|---|---|---|
| 2014/0049533 | A1* | 2/2014 | Saitoh | G09G 3/34 345/213 |
| 2014/0176524 | A1* | 6/2014 | Lee | G09G 3/3233 345/212 |
| 2014/0347401 | A1* | 11/2014 | Hwang | G09G 3/3233 345/690 |
| 2015/0138172 | A1* | 5/2015 | Kim | G09G 3/2092 345/205 |
| 2015/0206499 | A1* | 7/2015 | Pyun | G09G 3/3611 345/212 |
| 2016/0321983 | A1* | 11/2016 | Kim | H01L 27/3276 |
| 2018/0190233 | A1* | 7/2018 | Jang | G09G 3/3677 |
| 2019/0305070 | A1* | 10/2019 | Lee | H05K 3/323 |
| 2020/0076182 | A1* | 3/2020 | Huang | G09G 3/36 |
| 2020/0394968 | A1* | 12/2020 | Kwon | G09G 3/3291 |

FOREIGN PATENT DOCUMENTS

| | | | |
|---|---|---|---|
| KR | 10-2018-0120312 | A | 11/2018 |
| KR | 10-2019-0041563 | A | 4/2019 |

* cited by examiner

DISPLAY DEVICE AND DRIVING METHOD THEREOF

CROSS-REFERENCE TO RELATED APPLICATION

This application claims priority to, and benefit of, Korean Patent Application No. 10-2019-0113141 filed in the Korean Intellectual Property Office on Sep. 11, 2019, the entire contents of which are incorporated herein by reference.

BACKGROUND

1. Field

Embodiments of the present disclosure relate to a display device, and to a driving method thereof.

2. Description of the Related Art

A display device includes a display panel, and a printed circuit board (PCB) on which components for driving the display panel are mounted. The printed circuit board may be electrically connected to the display panel through a flexible printed circuit board (FPCB) or the like.

The display panel includes a plurality of pixels, and a plurality of gate lines and a plurality of data lines connected to the pixels. A gate signal of a gate-on voltage is sequentially applied to the gate lines, and a data voltage is applied to the data lines corresponding to the gate signal of the gate-on voltage to display an image.

The gate signal is composed of a combination of a gate-on voltage and a gate-off voltage, and a clock signal and a power voltage supplied from a printed circuit board are used to generate the gate signal.

The above information disclosed in this Background section is only for enhancement of understanding of the background of the invention, and therefore may contain information that does not form the prior art.

SUMMARY

A printed circuit board may include a signal controller, a power supply, a clock signal generator, and the like, and the clock signal generator may generate a gate clock signal by using a clock signal received from the signal controller and a power voltage received from the power supply. The gate clock signal may be transmitted to the display panel, and the gate signal may be outputted by using the gate clock signal.

When the display panel and the printed circuit board (or the clock signal generator) are not electrically connected to each other, the signal controller, the power supply, and the like should not be output. In a state in which the display panel and the printed circuit board (or the clock signal generator) are not electrically connected to each other, a connection pad, an exposed wire, or the like may contact a foreign material or a conductive object. In this state, when the signal controller, the power supply, or the like is output, a short circuit may occur between wires, which may cause a circuit failure of the signal controller, the power supply, or the like.

The present disclosure provides a display device and a driving method thereof in which a signal controller, a power supply, and the like are not output while a display panel and a printed circuit board (or a clock signal generator) are not electrically connected with each other.

Embodiments of the present disclosure provide a display device including a display panel including a plurality of pixels, a power supply configured to generate a first power voltage and a second power voltage, a signal controller configured to generate a first clock signal and a second clock signal having a period, a clock signal generator configured to generate a gate clock signal that is raised to a high level voltage in synchronization with the first clock signal, and that falls to a low level voltage in synchronization with the second clock signal, generate a panel separation signal by comparing a voltage of the gate clock signal with a first reference voltage during a falling period during which the gate clock signal falls, and transfer the panel separation signal to at least one of the power supply and the signal controller, and a gate driver configured to sequentially apply a gate signal having a gate-on voltage to the pixels by using the gate clock signal, wherein at least one of the power supply and the signal controller is configured to stop outputting depending on the panel separation signal.

The clock signal generator may include a clock signal generating circuit configured to generate the gate clock signal, and configured to apply the gate clock signal to a clock line electrically connected with the gate driver, a discharge circuit configured to discharge a voltage of the clock line during the falling period, and a panel separation detection circuit configured to generate the panel separation signal by comparing a detection voltage detected from the clock line with the first reference voltage during the falling period.

The discharge circuit may include a first transistor including a gate electrode to which the second clock signal is applied, a first electrode electrically connected to the clock line, and a second electrode electrically connected to a ground.

The panel separation detection circuit may include a comparator including a first input terminal to which the first reference voltage is inputted, a second input terminal to which the detection voltage is inputted, and an output terminal for outputting a digital value depending on a comparison result of the first reference voltage and the detection voltage, and a second transistor including a gate electrode to which the second clock signal is applied, a first electrode electrically connected to the clock line, and a second electrode electrically connected to a second input terminal of the comparator.

The panel separation detection circuit may be configured to generate a panel separation signal having a first digital value indicating that the display panel and the clock signal generator are electrically connected to each other when the detection voltage is higher than the first reference voltage.

The panel separation detection circuit may be configured to generate a panel separation signal having a second digital value indicating that the display panel and the clock signal generator are electrically separated from each other when the detection voltage is lower than the first reference voltage.

At least one of the power supply and the signal controller may be configured to stop outputting when the panel separation signal is received as the second digital value.

The clock signal generating circuit may be configured to raise a voltage of the gate clock signal to the high level voltage in synchronization with a rising time of the first clock signal, and to lower a voltage of the gate clock signal to the low level voltage in synchronization with a falling time of the second clock signal.

The falling period may be a period between the rising time and the falling time of the second clock signal.

The discharge circuit may include a first transistor including a gate electrode to which the second clock signal is applied, and a first electrode electrically connected to the clock line, and an operational amplifier including a first input terminal to which a second reference voltage is inputted, and a second input terminal and an output terminal that are commonly electrically connected to a second electrode of the first transistor.

The second reference voltage may be higher than the low level voltage, and lower than the first reference voltage.

The panel separation detection circuit may be configured to generate a panel separation signal having a first digital value indicating that the display panel and the clock signal generator are electrically connected to each other when the detection voltage is higher than the first reference voltage.

The panel separation detection circuit may be configured to generate a panel separation signal having a second digital value indicating that the display panel and the clock signal generator are electrically separated from each other when the detection voltage is lower than the first reference voltage.

At least one of the power supply and the signal controller may be configured to stop outputting when the panel separation signal is received as the second digital value.

Embodiments of the present disclosure provide a driving method of a display device including a clock signal generator, the method including receiving a first power voltage and a second power voltage from a power supply, receiving a first clock signal and a second clock signal, each having a period, from a signal controller, generating a gate clock signal raising to a high level voltage in synchronization with the first clock signal, and falling to a low level voltage in synchronization with the second clock signal, sequentially applying a gate signal of a gate-on voltage to a display panel by using the gate clock signal, and outputting a panel separation signal according to a comparison of a detection voltage of the gate clock signal with a first reference voltage during a falling period in which the gate clock signal falls, wherein the sequentially applying of the gate signal of the gate-on voltage to the display panel is continuously performed when the panel separation signal has a first digital value, and wherein at least one of the power supply and the signal controller stops outputting when the panel separation signal has a second digital value.

The driving method may further include raising a voltage of the gate clock signal to the high level voltage in synchronization with a rising time of the first clock signal, and lowering a voltage of the gate clock signal to the low level voltage in synchronization with a falling time of the second clock signal.

The falling period may be a period between the rising time and the falling time of the second clock signal.

The driving method may further include transferring, to at least one of the power supply and the signal controller, the panel separation signal of the first digital value indicating that the display panel and the clock signal generator are electrically connected to each other when the detection voltage is higher than the first reference voltage.

The driving method may further include transferring, to at least one of the power supply and the signal controller, the panel separation signal of the second digital value indicating that the display panel and the clock signal generator are electrically separated from each other when the detection voltage is lower than the first reference voltage.

A voltage of the gate clock signal may fall to a ground voltage or a second reference voltage that is lower than the first reference voltage during the falling period.

When the display panel and the printed circuit board (or the clock signal generator) are not electrically connected to each other, the signal controller, the power supply, and the like should not be output. Circuit failures of the signal controller and the power supply due to output of the signal controller and the power supply can be avoided when the display panel and the printed circuit board (or clock signal generator) are not electrically connected with each other. When the display panel and the printed circuit board (or the clock signal generator) are not electrically connected to each other, the possibility of reverse engineering of the product can be reduced or prevented by preventing the signal controller, the power supply, or the like from producing an output.

DETAILED DESCRIPTION

Figure 1:
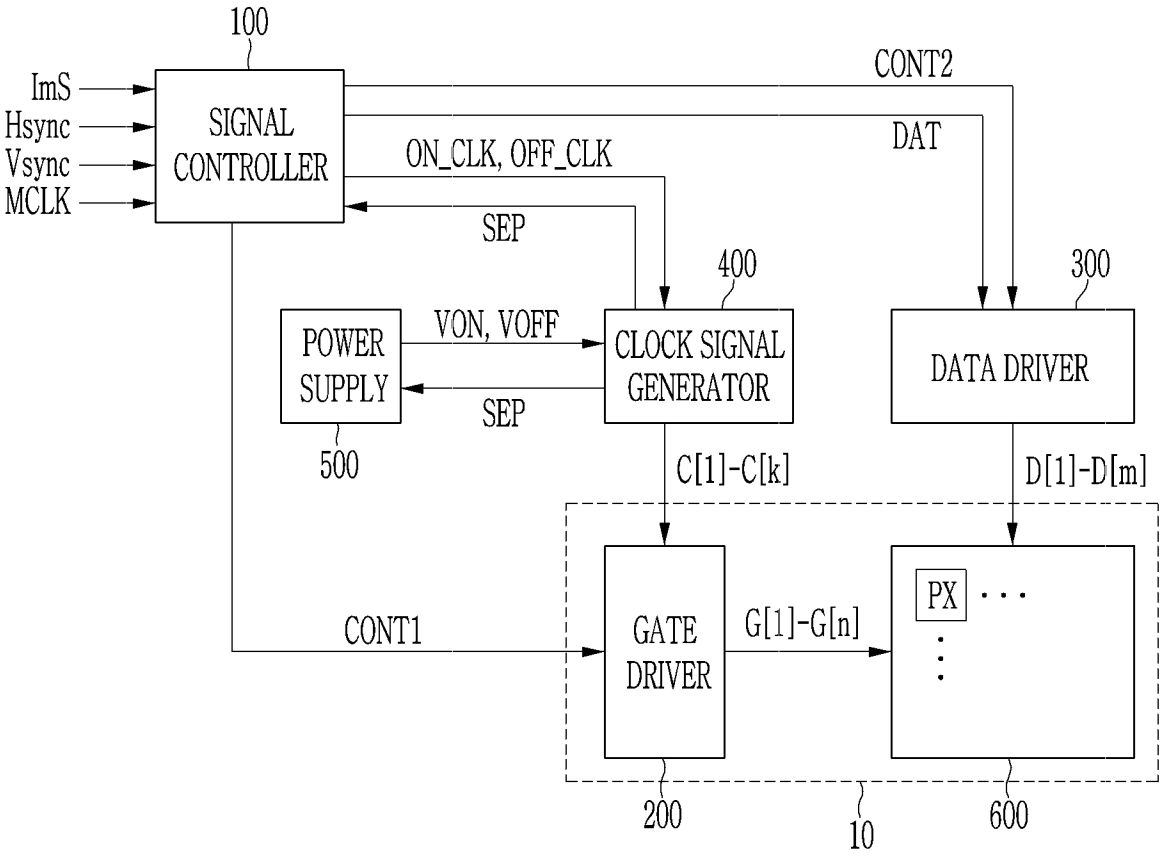
FIG. 1 illustrates a block diagram showing a display device according to embodiments of the present disclosure.

Features of the inventive concept and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described.

Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate.

Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Hereinafter, a display device according to embodiments of the present disclosure will be described with reference to FIG. 1 to FIG. 3.

FIG. 1 illustrates a block diagram showing a display device according to embodiments of the present disclosure.

Referring to FIG. 1, the display device includes a signal controller 100, a gate driver 200, a data driver 300, a clock signal generator 400, a power supply 500, and a display 600.

The signal controller 100 receives an image signal ImS and a synchronization signal that are inputted from an external device. The image signal ImS includes luminance information of a plurality of pixels PX corresponding to a number (e.g., a predetermined number) of gray levels. The synchronization signal includes a horizontal synchronization signal Hsync, a vertical synchronization signal Vsync, and a main clock signal MCLK.

The signal controller 100 generates a first driving control signal CONT1, a second driving control signal CONT2, and an image data signal DAT depending on the image signal ImS, the horizontal synchronization signal Hsync, the vertical synchronization signal Vsync, and the main clock signal MCLK. The signal controller 100 divides the image signal ImS in units of frames depending on the vertical synchronization signal Vsync, and divides the image signal ImS in units of gate lines depending on the horizontal synchronization signal Hsync, to thereby generate the image data signal DAT. The signal controller 100 transfers the first driving control signal CONT1 to the gate driver 200, and transmits the image data signal DAT and the second driving control signal CONT2 to the data driver 300.

The signal controller 100 generates a first clock signal ON_CLK and a second clock signal OFF_CLK having a period (e.g. a predetermined period). The first clock signal ON_CLK and the second clock signal OFF_CLK are clock signals for generating gate clock signals C[1] to C[k]. Periods of the first clock signal ON_CLK and the second clock signal OFF_CLK may be one horizontal period. One horizontal period may be the same as a period of the horizontal synchronization signal Hsync. However, the periods of the first clock signal ON_CLK and the second clock signal OFF_CLK may be changed depending on operating conditions of the display device.

The signal controller 100 transmits the first clock signal ON_CLK and the second clock signal OFF_CLK to the clock signal generator 400.

The display 600 includes a plurality of pixels PX to display an image. The display 600 includes a plurality of gate lines connected to the pixels PX, and a plurality of data lines connected to the pixels PX. The gate lines may extend substantially in a row direction to be substantially parallel to each other. The data lines may extend substantially in a column direction to be substantially parallel to each other. The pixels PX may be respectively arranged in an area where the gate lines and the data lines cross each other.

The power supply 500 generates a first power voltage VON and a second power voltage VOFF to supply them to the clock signal generator 400. The first power voltage VON may be higher than the second power voltage VOFF, and the second power voltage VOFF may be lower than the first power voltage VON.

The clock signal generator 400 generates the gate clock signals C[1] to C[k] by using the first power voltage VON, the second power voltage VOFF, the first clock signal ON_CLK, and the second clock signal OFF_CLK. The clock signal generator 400 may generate one or more gate clock signals C[1] to C[k] (where k is an integer of 1 or more) that rise in synchronization with the first clock signal ON_CLK and that fall in synchronization with the second clock signal OFF_CLK. The gate clock signals C[1] to C[k] may rise to a high level voltage (e.g., VGH in FIG. 5 and FIG. 7) converted from the first supply voltage VON, and may fall to a low level voltage (e.g., VGL in FIG. 5 and FIG. 7) converted from the second power voltage VOFF. The clock signal generator 400 transfers the gate clock signals C[1] to C[k] to the gate driver 200.

The gate driver 200 is connected to the gate lines. The gate driver 200 generates a plurality of gate signals G[1] to G[n] by using the first driving control signal CONT1 and the gate clock signals C[1] to C[k]. The first driving control signal CONT1 may include a scan start signal indicating the start of output of the gate driver 200. The gate signals G[1] to G[n] consist of a combination of a gate-on voltage and a gate off voltage. The gate driver 200 may output the gate clock signals C[1] to C[k] as the gate signals G[1] to G[n]. The gate-on voltage may be a high level voltage VGH, and the gate-off voltage may be a low level voltage VGL. The low level voltage VGL may be a ground voltage. The gate driver 200 may sequentially apply gate signals G[1] to G[n] having a gate-on voltage to the gate lines.

The data driver 300 is connected to a plurality of data lines, and is configured to sample and hold the image data signal DAT depending on the second driving control signal CONT2, and to supply the data signals D[1] to D[m] to the data lines. The data driver 300 applies data signals D[1] to D[m] having a voltage range (e.g., a predetermined voltage range) to the data lines to correspond to the gate signals G[1] to G[n] of the gate-on voltage.

The gate driver 200 and the display 600 may be included in a display panel 10 including at least one substrate. The display panel 10 includes a display area in which an image is displayed, and a peripheral area positioned around the display area. The display 600 may correspond to the display area. The gate driver 200 may be located to extend along one side of the display area in the peripheral area. For example, the gate driver 200 may be directly formed on a substrate of the display panel 10 by an amorphous silicon gate (ASG) method or an oxide silicon gate (OSG) method.

The data driver 300 may be mounted on a flexible printed circuit board (FPCB) in a chip on film (COF) manner, and may be electrically connected to the display panel 10 through the flexible printed circuit board.

The signal controller 100, the clock signal generator 400, the power supply 500, and the like may be formed as IC chips to be mounted on a printed circuit board, and may be electrically connected to the display panel 10 through the flexible printed circuit board.

Meanwhile, although it is illustrated in FIG. 1 that the gate driver 200 is located at one side of the display 600, gate drivers 200 may be respectively located at opposite sides of the display 600, and the gate signals G[1] to G[n] may be respectively applied from the opposite sides of the display 600.

Figure 5:
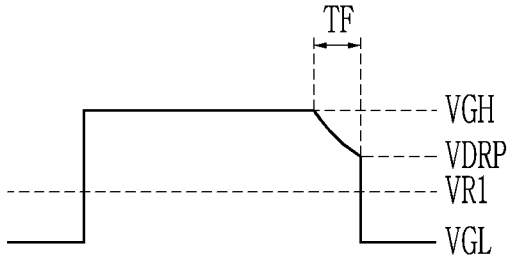
FIG. 5 illustrates any one gate clock signal of FIG. 4.
Figure 7:
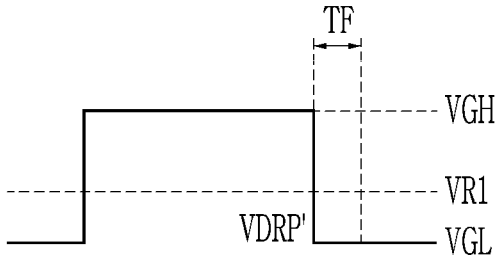
FIG. 7 illustrates any one gate clock signal of FIG. 6.

The clock signal generator 400 may lower the gate clock signals C[1] to C[k] of the high level voltage VGH during a falling period (e.g., see TF of FIG. 5 and FIG. 7). The clock signal generator 400 generates a panel separation signal SEP by comparing voltages of the gate clock signals C[1] to C[k] with a reference voltage (e.g., see VR1 in FIG. 5 and FIG. 7) during the falling period TF. The panel separation signal SEP may include a first digital value indicating that the display panel 10 and the clock signal generator 400 are electrically connected to each other, or a second digital value indicating that the display panel 10 and the clock signal generator 400 are electrically separated from each other. In other words, the panel separation signal SEP may indicate whether the display panel 10 is electrically connected to the printed circuit board on which the signal controller 100, the clock signal generator 400, the power supply 500, and the like are mounted. The clock signal generator 400 transfers the panel separation signal SEP to at least one of the signal controller 100 and the power supply 500.

The signal controller 100 and the power supply 500 may stop the output depending on the panel separation signal SEP. For example, the signal controller 100 and the power supply 500 continuously perform operations for displaying an image when the panel separation signal SEP is received as the first digital value. The signal controller 100 and the power supply 500 stop the output when the panel separation signal SEP is received as the second digital value. That is, when the signal controller 100 receives the panel separation signal SEP of the second digital value, the signal controller 100 stops the output of the first driving control signal CONT1, the second driving control signal CONT2, the image data signal DAT, the first clock signal ON_CLK, and the second clock signal OFF_CLK. When the power supply 500 receives the panel separation signal SEP of the second digital value, the power supply 500 stops the output of the first power voltage VON, the second power voltage VOFF, and the like.

As such, it is possible to prevent a circuit failure of the signal controller 100, the power supply 500, and the like from occurring by allowing the signal controller 100, the power supply 500, and the like to not produce any output in a state where the display panel 10 and the printed circuit board are not electrically connected to each other.

Figure 2:
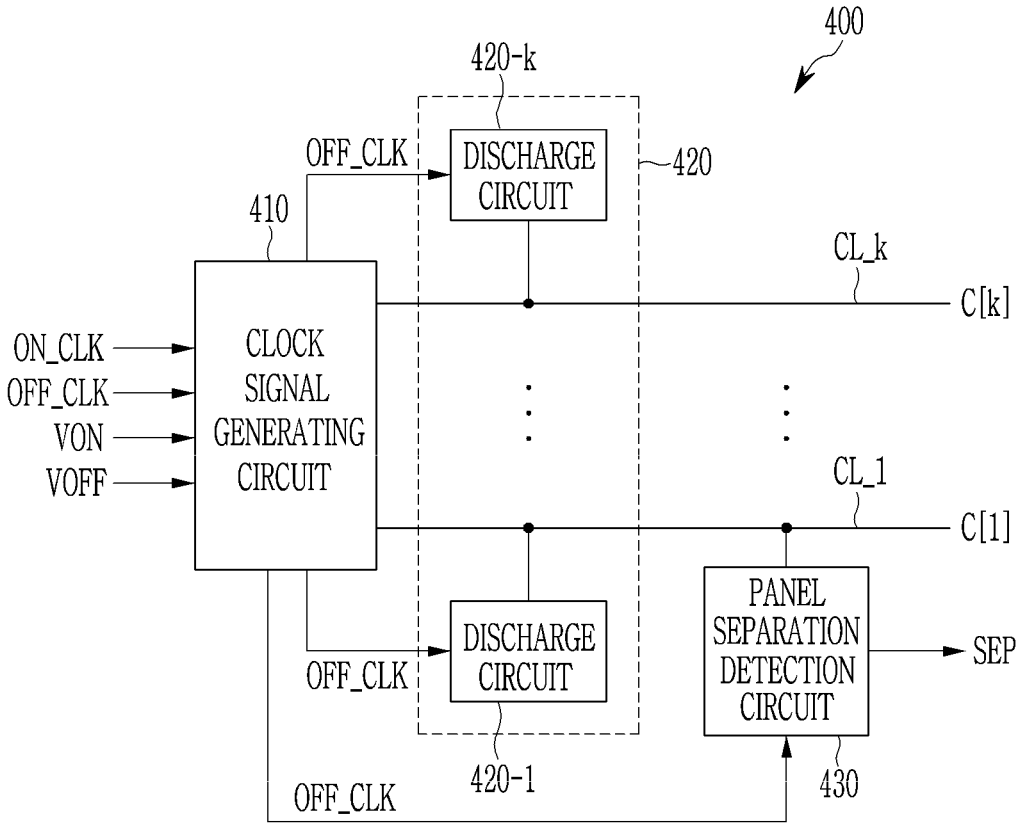
FIG. 2 illustrates a block diagram showing a clock signal generator according to embodiments of the present disclosure.

FIG. 2 illustrates a block diagram showing a clock signal generator according to embodiments of the present disclosure.

Referring to FIG. 2, the clock signal generator 400 includes a clock signal generating circuit 410, a discharge circuit(s) 420, and a panel separation detection circuit 430.

The clock signal generating circuit 410 is connected to a plurality of clock lines CL_1, . . . , and CL_k, and generates the gate clock signals C[1] to C[k] by using the first clock signal ON_CLK, the second clock signal OFF_CLK, the first power voltage VON, and the second power voltages VOFF. The gate clock signals C[1] to C[k] may be generated to have the high level voltage VGH at different times. The clock lines CL_1, . . . , and CL_k are connected to the gate driver 200. A number of clock lines CL_1, . . . , and CL_k may be equal to that of the gate clock signals C[1] to C[k]. The clock signal generating circuit 410 applies the gate clock signals C[1] to C[k] to the clock lines CL_1, . . . , and CL_k. The clock signal generating circuit 410 may apply the second clock signal OFF_CLK to the discharge circuit(s) 420 and the panel separation detection circuit 430.

In some embodiments, the discharge circuit 420 includes a plurality of respective individual discharge circuits 420-1, . . . , and **420-*k*. The discharge circuits 420-1, . . . , and 420-*k* are connected to the clock lines CL_1, CL_k one by one. Each of the discharge circuits 420-1, . . . , and 420-*k* receives the second clock signal OFF_CLK from the clock signal generating circuit 410, and discharges voltages of the clock lines CL_1, . . . , and CL_k depending on the second clock signal OFF_CLK during the falling period TF. The clock signal generating circuit 410 may apply the second clock signal OFF_CLK to the discharge circuits 420-1, . . . , and 420-*k* at different times. A time when the second clock signal OFF_CLK is applied to each of the plurality of discharge circuits 420-1, . . . , and 420-*k***, respectively, may correspond to the respective falling period TF of the gate clock signals C[1] to C[k].

The panel separation detection circuit 430 is connected to one of the clock lines CL_1, . . . , and CL_k. Hereinafter, as illustrated in FIG. 2, a following description will be made by using an example in which the panel separation detection circuit 430 is connected to the first clock line CL_1. The panel separation detection circuit 430 may generate the panel separation signal SEP by comparing a detection voltage (e.g., see VDRP of FIG. 5 and VDRP' of FIG. 7) detected from the first clock line CL_1 with a first reference voltage VR1 depending on the second clock signal OFF_CLK during the falling period TF.

Figure 3:
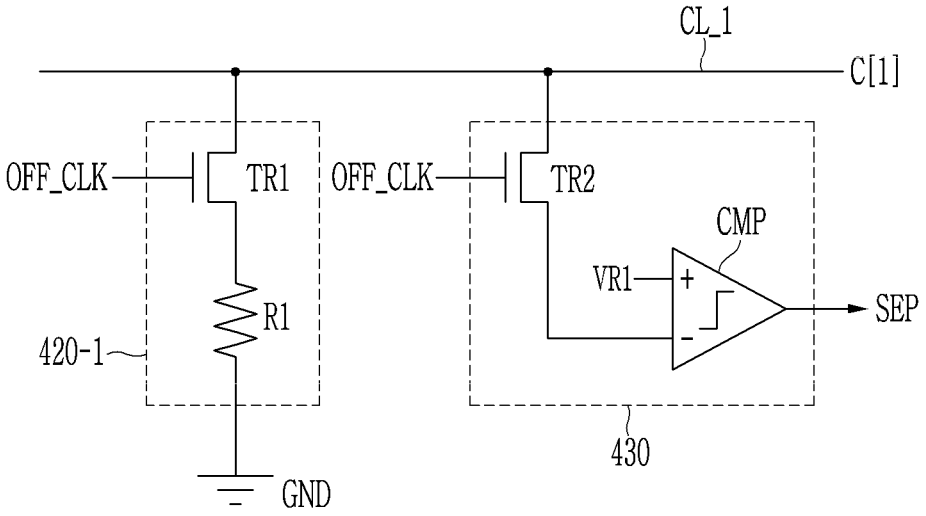
FIG. 3 illustrates a discharge circuit and a panel separation detection circuit according to embodiments of the present disclosure.

FIG. 3 illustrates a discharge circuit and a panel separation detection circuit according to embodiments of the present disclosure. The first discharge circuit 420-1 connected to the first clock line CL_1 among the discharge circuits 420-1, . . . , and **420-*k* illustrated in FIG. 2** will be described as an example.

Referring to FIG. 3, the first discharge circuit 420-1 may include a first transistor TR1 and a discharge resistor R1.

The first transistor TR1 includes a gate electrode to which the second clock signal OFF_CLK is applied, a first electrode connected to the first clock line CL_1, and a second electrode electrically connected to a ground GND.

The discharge resistor R1 is connected between the second electrode of the first transistor TR1 and the ground GND.

The discharge circuits 420-1, . . . , and **420-*k* may have a same configuration as the first discharge circuit 420-1 illustrated in FIG. 3**.

The panel separation detection circuit 430 includes a second transistor TR2 and a comparator CMP.

The second transistor TR2 includes a gate electrode to which the second clock signal OFF_CLK is applied, a first electrode connected to the first clock line CL_1, and a second electrode electrically connected to a second input terminal (−) of the comparator CMP.

The comparator CMP includes a first input terminal (+) through which the first reference voltage VR1 is inputted, a second input terminal (−) connected to a second electrode of the second transistor TR2, and an output terminal outputting a panel separation signal SEP. The comparator CMP compares the detection voltages VDRP and VDRP' inputted through the second transistor TR2 and the first reference voltage VR1, and outputs the result as a digital value.

When the second clock signal OFF_CLK is applied as the gate-off voltage so that the first transistor TR1 and the second transistor TR2 are turned off, the first gate clock signal C[1] of the high level voltage VGH is applied to the first clock line CL_1.

Thereafter, when the second clock signal OFF_CLK is applied as the gate-on voltage during the falling period TF, the first transistor TR1 and the second transistor TR2 are turned on. The high voltage VGH of the first clock line CL_1 is discharged through the first transistor TR1, and the detection voltages VDRP and VDRP' that are lower than the high level voltage VGH are inputted into the second input terminal (−) of the comparator CMP.

When the display panel 10 and the printed circuit board are electrically connected (that is, when the display panel 10 and the clock signal generator 400 are electrically connected) to each other, a voltage of the first clock line CL_1 falls to the detection voltage VDRP of a specific level, which is higher than the first reference voltage VR1, due to electrical loads of the wires and the transistors included in the display panel 10, as opposed to falling to the ground voltage. The detection voltage VDRP that is higher than the first reference voltage VR1 is inputted into the second input terminal (−) of the comparator CMP, and the comparator CMP outputs the panel separation signal SEP of the first digital value (e.g., a SEP value '0' of FIG. 4). The panel separation signal SEP of a first digital value 0 indicates that the display panel 10 and the printed circuit board (or the clock signal generator 400) are electrically connected to each other.

When the display panel 10 and the printed circuit board are electrically separated (e.g., when the display panel 10 and the clock signal generator 400 are electrically separated) from each other, there is no load in the first clock line CL_1, and thus the voltage of the first clock line CL_1 falls to the ground voltage. The detection voltage VDRP of the ground voltage, which is lower than the first reference voltage VR1, is inputted into the second input terminal (−) of the comparator CMP, and the comparator CMP outputs the panel separation signal SEP of the second digital value (e.g., a SEP value '1' of FIG. 6). The panel separation signal SEP of a second digital value 1 indicates that the display panel 10 and the printed circuit board (or the clock signal generator 400) are electrically separated from each other.

Hereinafter, a driving method of the display device when the display panel 10 and the printed circuit board (or the clock signal generator 400) are electrically connected to each other will be described with reference to FIG. 4 and FIG. 5 in addition to FIGS. 1-3. In addition, a driving method of the display device when the display panel 10 and the printed circuit board (or the clock signal generator 400) are electrically separated from each other will be described with reference to FIG. 6 and FIG. 7 in addition to FIGS. 1-3.

Hereinafter, a description will be given by taking an example in which the number of clock lines CL_1, . . . , and CL_6 is six.

Figure 4:
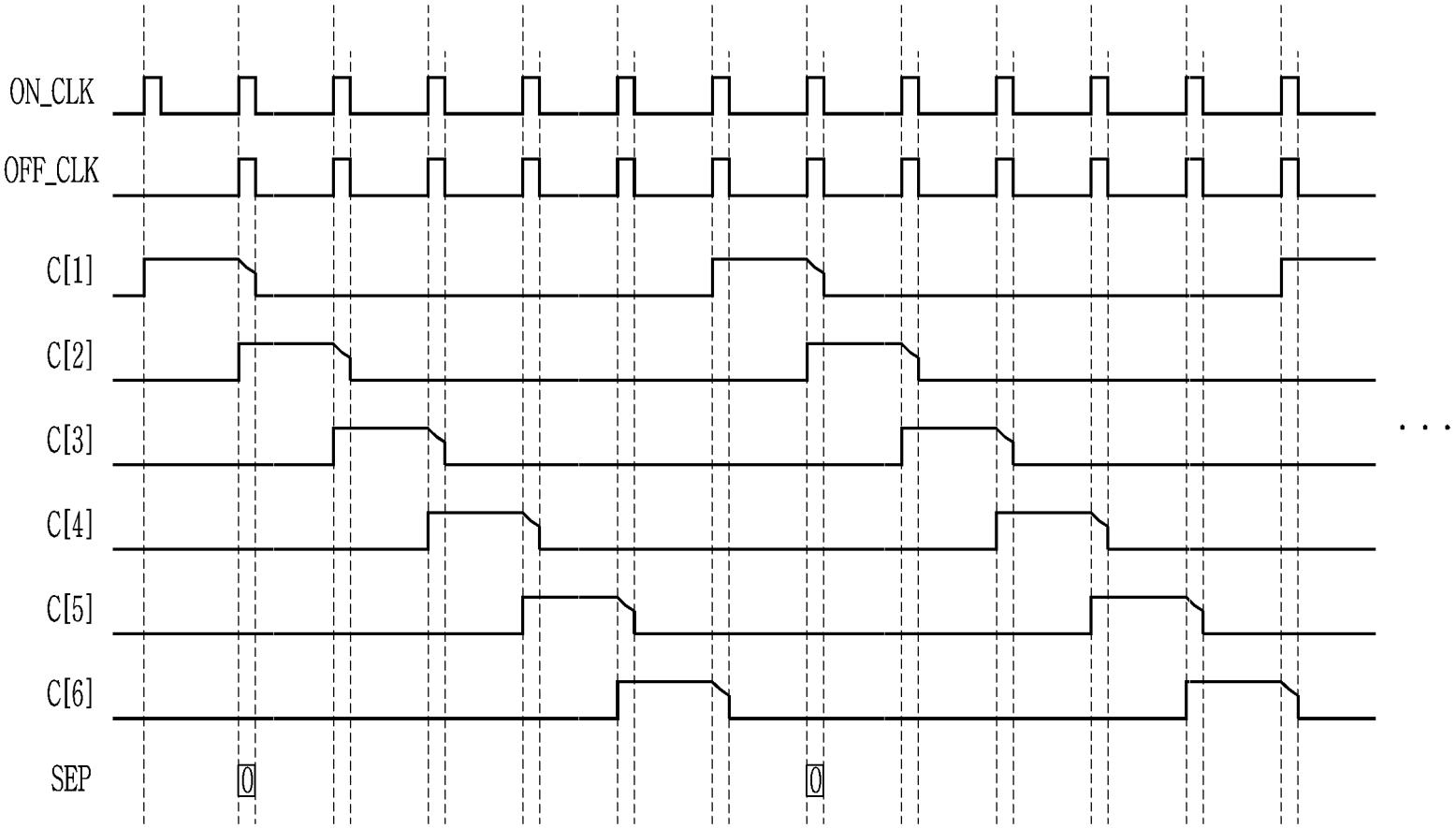
FIG. 4 illustrates a timing diagram showing a driving method of a display device according to embodiments of the present disclosure when the display panel is electrically connected with a printed circuit board.

FIG. 4 illustrates a timing diagram showing a driving method of a display device according to embodiments of the present disclosure when the display panel is electrically connected with a printed circuit board. FIG. 5 illustrates any one gate clock signal of FIG. 4.

Referring to FIG. 4 and FIG. 5, the clock signal generating circuit 410 receives the first clock signal ON_CLK and the second clock signal OFF_CLK having a period (e.g. a predetermined period) from the signal controller 100. The first clock signal ON_CLK and the second clock signal OFF_CLK may be pulse signals that are outputted as on voltages every period (e.g., one horizontal period). The second clock signal OFF_CLK may be a signal in which the first clock signal ON_CLK is delayed by one horizontal period and then outputted. The first clock signal ON_CLK and the second clock signal OFF_CLK may be outputted at the same time, and a rising time and a falling time of the first clock signal ON_CLK and the second clock signal OFF_CLK that are substantially simultaneously outputted may be the same.

The clock signal generating circuit 410 receives the first power voltage VON and the second power voltage VOFF from the power supply 500.

The clock signal generating circuit 410 raises the voltage of the first gate clock signal C[1] to the high level voltage VGH in synchronization with the rising time of any one first clock signal ON_CLK. The high level voltage VGH may be a voltage that is converted from the first power voltage VON. The clock signal generating circuit 410 lowers the voltage of the first gate clock signal C[1] to the low level voltage VGL in synchronization with the falling time of the next rising second clock signal OFF_CLK. The clock signal generating circuit 410 raises the voltage of the second gate clock signal C[2] to the high level voltage VGH in synchronization with the rising time of the first clock signal ON_CLK that is raised at the same time as the next second clock signal OFF_CLK that is raised.

The second clock signal OFF_CLK is transferred to the first discharge circuit 420-1 during the falling period TF between the rising time and the falling time of the second clock signal OFF_CLK, and the high level voltage VGH of the first clock line CL_1 is discharged through the first discharge circuit 420-1. The voltage of the first gate clock signal C[1] falls to the detection voltage VDRP, which is higher than the first reference voltage VR1 due to the loads of the wires and the transistors included in the display panel 10, instead of falling to the ground voltage. The first reference voltage VR1 may be a voltage that is higher (e.g., higher by a predetermined level) than the low level voltage VGL or the ground voltage.

The voltage of the first gate clock signal C[1] falls from the detection voltage VDRP to the low level voltage VGL at the falling time of the second clock signal OFF_CLK. The first gate clock signal C[1] generated as described above is applied to the first clock line CL_1.

The second clock signal OFF_CLK is transferred to the panel separation detection circuit 430 during the falling period TF between the rising time and the falling time of the second clock signal OFF_CLK, thereby turning on the second transistor TR2. The panel separation detection circuit 430 outputs the panel separation signal SEP of the first digital value 0 by comparing the detection voltage VDRP of the first clock line CL_1 with the first reference voltage VR1. The panel separation signal SEP of the first digital value 0 is a signal indicating that the display panel 10 and the printed circuit board (or the clock signal generator 400) are electrically connected to each other. In practice, the panel separation detection circuit 430 may output the panel separation signal SEP by receiving the voltage of the first clock line CL_1 just before the falling time of the second clock signal OFF_CLK as the detection voltage VDRP, and by comparing it with the first reference voltage VR1.

The panel separation signal SEP of the first digital value 0 is transmitted to at least one of the signal controller 100 and the power supply 500. The signal controller 100 may continuously output the first clock signal ON_CLK and the second clock signal OFF_CLK when the panel separation signal SEP is the first digital value 0. The power supply 500 may continuously output the first power voltage VON and the second power voltage VOFF when the panel separation signal SEP is the first digital value 0.

The clock signal generating circuit 410 sequentially generates the second gate clock signal C[2] to the sixth gate clock signal C[6] in a same manner as the first gate clock signal C[1]. The clock signal generating circuit 410 sequentially applies the first to sixth gate clock signals C[1], C[2], C[3], C[4], C[5], and C[6] to the first to sixth clock lines CL_1, . . . , and CL_6. Sequential application of the first to sixth gate clock signals C[1], C[2], C[3], C[4], C[5], and C[6] is repeatedly performed. The gate driver 200 may sequentially apply the gate signals G[1] to G[n] of the gate-on voltage to the pixels PX by using the first to sixth gate clock signals C[1], C[2], C[3], C[4], C[5], and C[6] applied sequentially and repeatedly. That is, when the panel separation signal SEP is the first digital value 0, a process of applying the gate signals G[1] to G[n] of the gate-on voltage to the display panel 10 is continuously performed.

Figure 6:
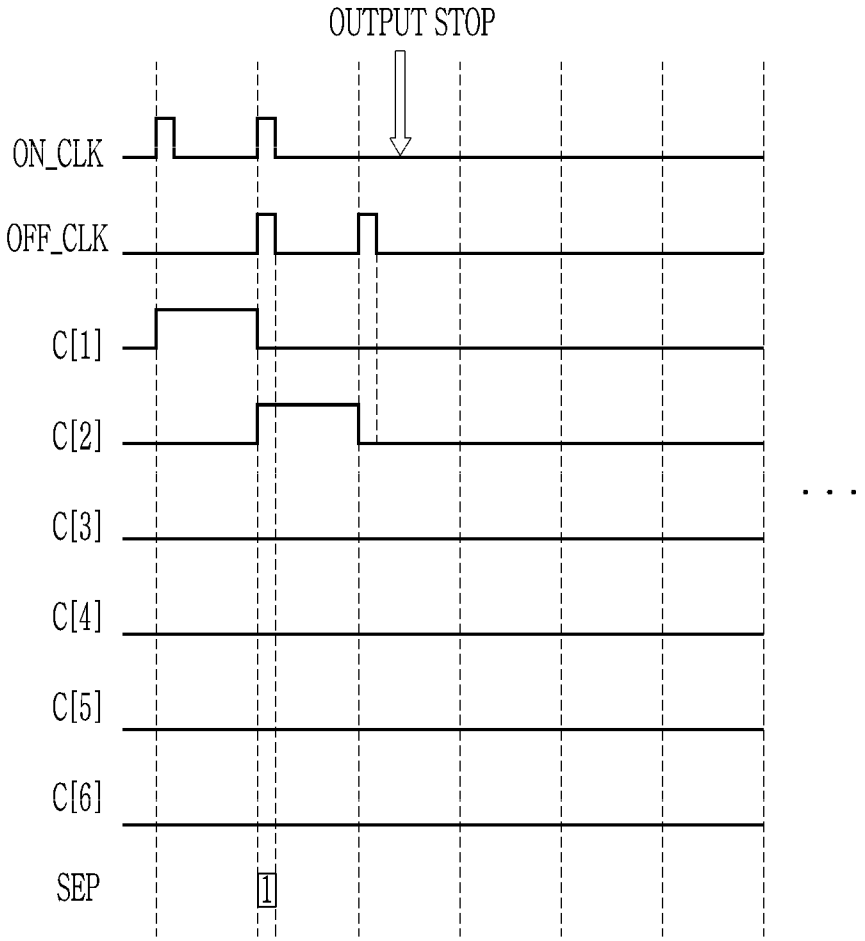
FIG. 6 illustrates a timing diagram showing a driving method of a display device according to embodiments of the present disclosure when the display panel is electrically separated from a printed circuit board.

FIG. 6 illustrates a timing diagram showing a driving method of a display device according to embodiments of the present disclosure when the display panel is electrically separated from a printed circuit board. FIG. 7 illustrates any one gate clock signal of FIG. 6.

Referring to FIG. 6 and FIG. 7, when the display panel 10 and the printed circuit board (or the clock signal generator 400) are electrically separated from each other, electrical loads of the wires and the transistors included in the display panel 10 are reduced, and thus the high level voltage VGH of the first clock line CL_1 may fall to the ground voltage that is lower than the first reference voltage VR1 due to the first discharge circuit 420-1 during the falling period TF. The low level voltage VGL is applied to the first clock line CL_1 in synchronization with the falling time of the second clock signal OFF_CLK. The first gate clock signal C[1] generated as described above is applied to the first clock line CL_1.

The voltage of the first clock line CL_1, which falls to the ground voltage during the falling period TF, is received by the panel separation detection circuit 430 as the detection voltage VDRP'. The panel separation detection circuit 430 outputs the panel separation signal SEP of the second digital value 1 by comparing the detection voltage VDRP' of the first clock line CL_1 with the first reference voltage VR1. The panel separation signal SEP of a second digital value 1 is a signal indicating that the display panel 10 and the printed circuit board (or the clock signal generator 400) are separated from each other.

The panel separation signal SEP of the second digital value 1 is transmitted to at least one of the signal controller 100 and the power supply 500. The signal controller 100 may stop the output of the first clock signal ON_CLK and the second clock signal OFF_CLK when the panel separation signal SEP is received as the second digital value 1. The power supply 500 may stop the output of the first power voltage VON and the second power voltage VOFF when the panel separation signal SEP is received as the second digital value 1.

Accordingly, the clock signal generator 400 may not receive the first clock signal ON_CLK, the second clock signal OFF_CLK, the first power voltage VON, the second power voltage VOFF, and the like, and the output of the clock signal generator 400 may also be stopped. That is, when the panel separation signal SEP is the second digital value 1, a process of applying the gate signals G[1] to G[n] of the gate-on voltage to the display panel 10 is stopped.

Hereinafter, a discharge circuit according to another embodiment will be described with reference to FIG. 8, and voltage variations of the gate clock signal by the discharge circuit of FIG. 8 will be described with reference to FIG. 9 and FIG. 10.

Figure 8:
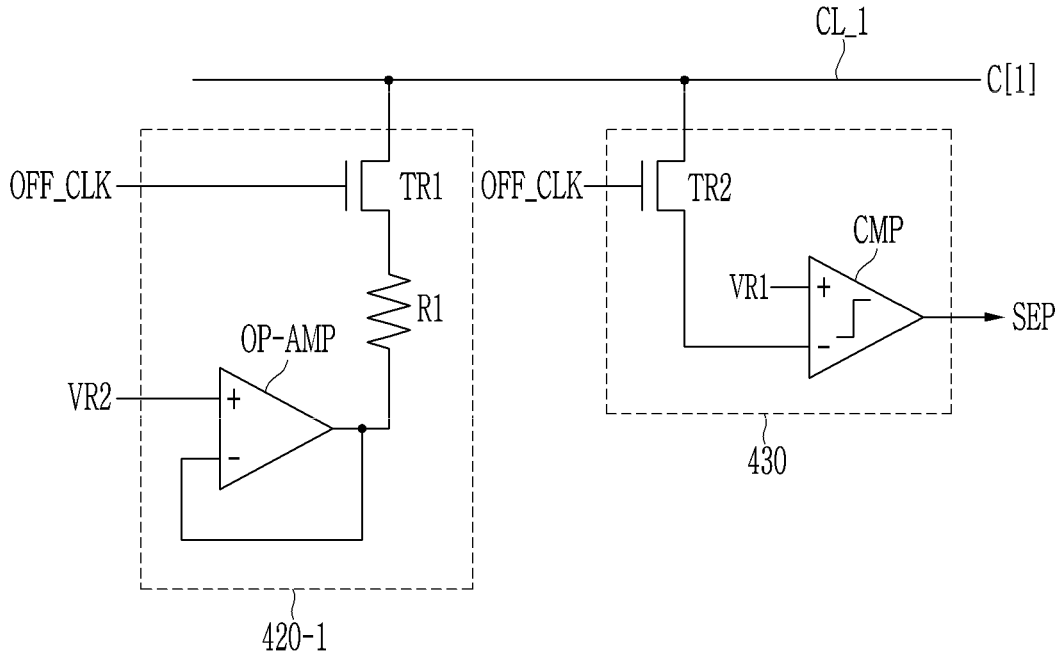
FIG. 8 illustrates a discharge circuit and a panel separation detection circuit according to other embodiments of the present disclosure.

FIG. 8 illustrates a discharge circuit and a panel separation detection circuit according to other embodiments of the present disclosure. The first discharge circuit 420-1 connected to the first clock line CL_1 among the discharge circuits 420-1, . . . , and 420-*k* illustrated in FIG. 2 will be described as an example.

Figure 9:
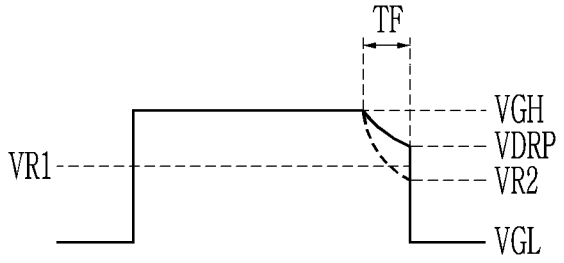
FIG. 9 illustrates one gate clock signal of which voltage is changed by the discharge circuit of FIG. 8 when the display panel is electrically connected with a printed circuit board.

FIG. 9 illustrates one gate clock signal of which voltage is changed by the discharge circuit of FIG. 8 when the display panel is electrically connected with a printed circuit board. FIG. 10 illustrates one gate clock signal of which voltage is changed by the discharge circuit of FIG. 8 when the display panel is electrically separated from a printed circuit board.

Referring to FIG. 8, the first discharge circuit 420-1 may include a first transistor TR1, a discharge resistor R1, and an operational amplifier OP-AMP.

The first transistor TR1 includes a gate electrode to which the second clock signal OFF_CLK is applied, a first electrode connected to the first clock line CL_1, and a second electrode electrically connected to an output terminal of the operational amplifier OP-AMP.

The discharge resistor R1 is connected between a second electrode of the first transistor TR1 and the output terminal of the operational amplifier OP-AMP.

The operational amplifier OP-AMP has a first input terminal (+) to which the second reference voltage VR2 is inputted, and a second input terminal (−) and an output terminal commonly connected to the second electrode of the first transistor TR1 (e.g., through the discharge resistor R1). The second reference voltage VR2 may be higher than a ground voltage and lower than the first reference voltage VR1. The operational amplifier OP-AMP supplies a second reference voltage VR2 to the output terminal such that the high level voltage VGH of the first clock line CL_1 falls to the second reference voltage VR2 when the first transistor TR1 is turned on.

The discharge circuits 420-1, . . . , and 420-*k* included in the discharge circuit(s) 420 of FIG. 2 may have a same configuration as the first discharge circuit 420-1 illustrated in FIG. 8.

In accordance with the above embodiments, the panel separation detection circuit 430 may be configured in a same manner as in the embodiment of FIG. 3, and a redundant description of the same configurations will be omitted.

When the display panel 10 and the printed circuit board (or the clock signal generator 400) are electrically connected to each other, a bandwidth "BW_opamp" of the operational amplifier OP-AMP may be determined as shown in Equation 1 such that the high level voltage VGH of the first clock line CL_1 does not fall to the second reference voltage VR2 during the falling period TF.

$$BW_opamp = A \times (0.35/TF) \quad \text{Equation 1}$$

Herein, TF indicates the falling period, and A indicates a delay coefficient. The delay coefficient A may be greater than zero and less than one.

As illustrated in FIG. 9, when the display panel 10 and the printed circuit board (or the clock signal generator 400) are electrically connected to each other, the voltage of the first clock line CL_1 does not fall to the second reference voltage VR2, but falls to the detection voltage VDRP that is higher than the first reference voltage VR1. Because the detection voltage VDRP that is higher than the first reference voltage VR1 is inputted into the second input terminal (−) of the comparator CMP, the panel separation signal SEP of the first digital value 0 is outputted. As described above with reference to FIG. 4, when the panel separation signal SEP is the first digital value 0, the signal controller 100 and the power supply 500 may continuously perform the output.

Figure 10:
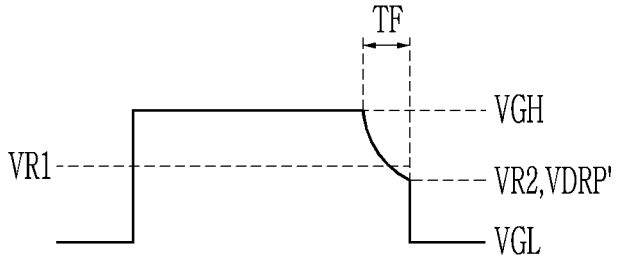
FIG. 10 illustrates one gate clock signal of which voltage is changed by the discharge circuit of FIG. 8 when the display panel is electrically separated from a printed circuit board.

As illustrated in FIG. 10, when the display panel 10 and the printed circuit board (or the clock signal generator 400) are electrically separated from each other, there is no load in the first clock line CL_1, and thus the voltage of the first clock line CL_1 falls to the second reference voltage VR2, which is lower than the first reference voltage VR1, during the falling period TF. Because the detection voltage VDRP' that is equal to the second reference voltage VR2 is inputted into the second input terminal (−) of the comparator CMP, the panel separation signal SEP of the second digital value 1 is outputted. As described above with reference to FIG. 6, the output of at least one of the signal controller 100 and the power supply 500 is stopped by the panel separation signal SEP of the second digital value 1, and a process of applying the gate signals G[1] to G[n] of the gate-on voltage to the display panel 10 may be stopped.

While embodiments of the present disclosure have been particularly shown and described with reference to the accompanying drawings, the specific terms used herein are only for the purpose of describing the invention and are not intended to define the meanings thereof or be limiting of the scope of the invention set forth in the claims. Therefore, those skilled in the art will understand that various modifications and other equivalent embodiments of the present disclosure are possible.

Consequently, the true technical protective scope of the present disclosure must be determined based on the technical spirit of the appended claims, with functional equivalents thereof to be included therein.

What is claimed is:

1. A display device comprising:

a display panel comprising a plurality of pixels;

a power supply configured to generate a first power voltage and a second power voltage;

a signal controller configured to generate a first clock signal and a second clock signal having a period;

a clock signal generator configured to:

generate a gate clock signal that is raised to a high level voltage in synchronization with the first clock signal, and that falls to a low level voltage in synchronization with the second clock signal;

generate a panel separation signal by comparing a voltage of the gate clock signal with a first reference voltage during a falling period during which the gate clock signal falls; and transfer the panel separation signal to at least one of the power supply and the signal controller; and a gate driver configured to sequentially apply a gate signal having a gate-on voltage to the pixels by using the gate clock signal, wherein at least one of the power supply and the signal controller is configured to stop outputting depending on the panel separation signal.

2. The display device of claim 1, wherein the clock signal generator comprises:

a clock signal generating circuit configured to generate the gate clock signal, and configured to apply the gate clock signal to a clock line electrically connected with the gate driver;

a discharge circuit configured to discharge a voltage of the clock line during the falling period; and a panel separation detection circuit configured to generate the panel separation signal by comparing a detection voltage detected from the clock line with the first reference voltage during the falling period.

3. The display device of claim 2, wherein the discharge circuit comprises a first transistor comprising a gate electrode to which the second clock signal is applied, a first electrode electrically connected to the clock line, and a second electrode electrically connected to a ground.

4. The display device of claim 2, wherein the panel separation detection circuit comprises:

a comparator comprising a first input terminal to which the first reference voltage is inputted, a second input terminal to which the detection voltage is inputted, and an output terminal for outputting a digital value depending on a comparison result of the first reference voltage and the detection voltage; and a second transistor comprising a gate electrode to which the second clock signal is applied, a first electrode electrically connected to the clock line, and a second electrode electrically connected to a second input terminal of the comparator.

5. The display device of claim 4, wherein the panel separation detection circuit is configured to generate a panel separation signal having a first digital value indicating that the display panel and the clock signal generator are electrically connected to each other when the detection voltage is higher than the first reference voltage.

6. The display device of claim 4, wherein the panel separation detection circuit is configured to generate a panel separation signal having a second digital value indicating that the display panel and the clock signal generator are electrically separated from each other when the detection voltage is lower than the first reference voltage.

7. The display device of claim 6, wherein at least one of the power supply and the signal controller is configured to stop outputting when the panel separation signal is received as the second digital value.

8. The display device of claim 2, wherein the clock signal generating circuit is configured to raise a voltage of the gate clock signal to the high level voltage in synchronization with a rising time of the first clock signal, and to lower a voltage of the gate clock signal to the low level voltage in synchronization with a falling time of the second clock signal.

9. The display device of claim 8, wherein the falling period is a period between the rising time and the falling time of the second clock signal.

10. The display device of claim 2, wherein the discharge circuit comprises:

a first transistor comprising a gate electrode to which the second clock signal is applied, and a first electrode electrically connected to the clock line; and an operational amplifier comprising a first input terminal to which a second reference voltage is inputted, and a second input terminal and an output terminal that are commonly electrically connected to a second electrode of the first transistor.

11. The display device of claim 10, wherein the second reference voltage is higher than the low level voltage, and lower than the first reference voltage.

12. The display device of claim 11, wherein the panel separation detection circuit is configured to generate a panel separation signal having a first digital value indicating that the display panel and the clock signal generator are electrically connected to each other when the detection voltage is higher than the first reference voltage.

13. The display device of claim 11, wherein the panel separation detection circuit is configured to generate a panel separation signal having a second digital value indicating that the display panel and the clock signal generator are electrically separated from each other when the detection voltage is lower than the first reference voltage.

14. The display device of claim 13, wherein at least one of the power supply and the signal controller is configured to stop outputting when the panel separation signal is received as the second digital value.

15. A driving method of a display device comprising a clock signal generator, the method comprising:

receiving a first power voltage and a second power voltage from a power supply;

receiving a first clock signal and a second clock signal, each having a period, from a signal controller;

generating a gate clock signal raising to a high level voltage in synchronization with the first clock signal, and falling to a low level voltage in synchronization with the second clock signal;

sequentially applying a gate signal of a gate-on voltage to a display panel by using the gate clock signal; and outputting a panel separation signal according to a comparison of a detection voltage of the gate clock signal with a first reference voltage during a falling period in which the gate clock signal falls, wherein the sequentially applying of the gate signal of the gate-on voltage to the display panel is continuously performed when the panel separation signal has a first digital value, and wherein at least one of the power supply and the signal controller stops outputting when the panel separation signal has a second digital value.

16. The driving method of claim 15, further comprising:

raising a voltage of the gate clock signal to the high level voltage in synchronization with a rising time of the first clock signal, and lowering a voltage of the gate clock signal to the low level voltage in synchronization with a falling time of the second clock signal.

17. The driving method of claim 16, wherein the falling period is a period between the rising time and the falling time of the second clock signal.

18. The driving method of claim 15, further comprising transferring, to at least one of the power supply and the signal controller, the panel separation signal of the first digital value indicating that the display panel and the clock signal generator are electrically connected to each other when the detection voltage is higher than the first reference voltage.

19. The driving method of claim 15, further comprising transferring, to at least one of the power supply and the signal controller, the panel separation signal of the second digital value indicating that the display panel and the clock signal generator are electrically separated from each other when the detection voltage is lower than the first reference voltage.

20. The driving method of claim 19, wherein a voltage of the gate clock signal falls to a ground voltage or a second reference voltage that is lower than the first reference voltage during the falling period.

* * * * *